US009194259B2

(12) United States Patent
Mitchell

(10) Patent No.: US 9,194,259 B2
(45) Date of Patent: Nov. 24, 2015

(54) APPARATUS FOR MINIMIZING SOLID PARTICLE EROSION IN STEAM TURBINES

(75) Inventor: Douglas Robert Mitchell, Malta, NY (US)

(73) Assignee: General Electric Company, Schenectady, NY (US)

( * ) Notice: Subject to any disclaimer, the term of this patent is extended or adjusted under 35 U.S.C. 154(b) by 636 days.

(21) Appl. No.: 13/485,055

(22) Filed: May 31, 2012

(65) Prior Publication Data

US 2013/0323019 A1 Dec. 5, 2013

(51) Int. Cl.
*F01B 25/02* (2006.01)
*F01D 25/32* (2006.01)

(52) U.S. Cl.
CPC ..... *F01D 25/32* (2013.01); *F05D 2220/31* (2013.01)

(58) Field of Classification Search
CPC ..... F01D 9/06; F01D 25/32; F05D 2220/31
USPC ..... 415/121.2, 144, 169.1, 58.6
See application file for complete search history.

(56) References Cited

U.S. PATENT DOCUMENTS

| | | | | |
|---|---|---|---|---|
| 3,066,912 A | | 3/1961 | Scheper | |
| 3,966,355 A | * | 6/1976 | Pierpoline | 415/144 |
| 4,335,995 A | * | 6/1982 | Riollet et al. | 415/144 |
| 4,615,734 A | | 10/1986 | Spriggs | |
| 4,704,336 A | | 11/1987 | Spriggs | |
| 4,767,247 A | | 8/1988 | Partington et al. | |
| 4,776,765 A | | 10/1988 | Sumner | |
| 5,984,628 A | * | 11/1999 | Gray et al. | 415/169.4 |
| 6,046,573 A | | 4/2000 | Wikstrom | |
| 7,001,145 B2 | | 2/2006 | Couture et al. | |
| 7,296,964 B2 | * | 11/2007 | Montgomery | 415/108 |
| 8,714,915 B2 | * | 5/2014 | Blatchford et al. | 415/121.2 |

(Continued)

FOREIGN PATENT DOCUMENTS

| | | |
|---|---|---|
| CN | 88100915 | 9/1988 |
| CN | 1080017 | 2/2002 |
| CN | 1619109 | 5/2005 |

(Continued)

OTHER PUBLICATIONS

GB Search and Examination Report dated Nov. 12, 2013, issued in connection with corresponding GB Patent Application No. GB1309004.8.

Chinese Office Action mailed Jul. 22, 2015, seven pages.

*Primary Examiner* — Dwayne J White
*Assistant Examiner* — Jason Fountain
(74) *Attorney, Agent, or Firm* — Nixon & Vanderhye P.C.

(57) ABSTRACT

Solid particle erosion in a steam turbine is minimized by diverting through angled slots formed in appendages of outer rings of the diaphragms, a portion of the steam from the steam flow path thereby bypassing downstream rotating components. The slot through the first stage appendage lies in communication with a passage through a downstream outer ring of a following stage such that the diverted solid particle containing steam may be extracted from the steam flow path and passed to the feed water heater of the turbine. The slot in the second stage appendage diverts steam from between the first and second stages and about the second stage. Solid particle erosion in various regions, i.e., the trailing edge of the stator vanes, along the surfaces of the buckets and in the regions of the cover and its connection with the buckets as well as the sealing devices is thereby minimized.

20 Claims, 7 Drawing Sheets

(56) References Cited

U.S. PATENT DOCUMENTS

| | | | |
|---|---|---|---|
| 2007/0071594 | A1 | 3/2007 | Montgomery |
| 2014/0301858 | A1 | 10/2014 | Feng Lin et al. |

FOREIGN PATENT DOCUMENTS

| | | | |
|---|---|---|---|
| CN | 102418562 | | 4/2012 |
| GB | 2475704 | A | 6/2011 |

* cited by examiner

APPARATUS FOR MINIMIZING SOLID PARTICLE EROSION IN STEAM TURBINES

FIELD OF THE INVENTION

The present invention relates to an apparatus for minimizing solid particle erosion in steam turbine components, and particularly relates to an apparatus for removing solid particles from the steam flow path to minimize damage to, for example, turbine buckets.

BACKGROUND OF THE INVENTION

Solid particle erosion of the components of a steam turbine occurs due to carryover of particles from the steam boiler and piping upstream of the turbine. The solid particles become entrained in the steam flow path. As they pass through the steam turbine, the particles cause damage to both the stationary and rotating parts of the turbine which degrades steam turbine performance and mechanical reliability. The solid particles may be deposited throughout the steam path or may exit the steam path into steam extractions that feed the feed water heaters of the cycle. However, since the particles are transported by the main steam flow through the steam turbine steam path, they have the opportunity to inflict considerable damage along the steam path before they are deposited or expelled from the main steam flow. This damage can include erosion of the rotating and stationary buckets and partitions respectively, erosion of the rotating tip covers or tenons, erosion of tip sealing devices such as spill strips and erosion of stationary structures over the tips of the rotating buckets.

Referring to FIG. 1, typical steam turbine stages of a conventional steam turbine are illustrated and generally designated 10. Two stages of the steam turbine are illustrated, for example, a first stage generally designated 12 and a second stage generally designated 14. The first stage 12 includes a diaphragm 16 having an inner web 18, an outer ring 20, and a plurality of circumferentially spaced stator vanes or partitions 22 therebetween. The first stage also includes buckets 24 secured to a rotor 26. The tips of the buckets 24 rotate past sealing devices 28 formed on an axially extending appendage 30 of the outer ring 20. The inner web 18 of the first stage diaphragm includes sealing segments 32, in this instance, mounting labyrinth seal teeth 34 for sealing about the rotor 26. The second stage 14 is similar and includes a diaphragm 36, an inner web 38, an outer ring 40, partitions 42 circumferentially spaced one from the other and disposed between the inner web and outer ring, the outer ring 40 having an appendage 44 overlying tips of buckets 46 mounted on the rotor 26. It will be appreciated that the steam flows through the illustrated stages in the direction of the arrow 48 rotating the rotor 26, thereby enabling useful work to be derived from the steam turbine.

Various apparatus and methods have been proposed and utilized to minimize the impact of the solid particles on the rotating and stationary parts of steam turbines. For example, in U.S. Pat. No. 4,776,765 a protective device is disposed over a portion of the suction side of the partition to prevent solid particle erosion of the trailing edge of the partition due to rebound of particles from the leading edge of the buckets. Other apparatus and methods for minimizing or eliminating solid particle erosion in steam turbines include solid particle erosion resistant coatings such as disclosed in U.S. Pat. Nos. 4,704,336 and 4,615,734.

An additional conventional apparatus is shown in FIGS. 2 and 3, wherein like reference numerals are applied to like parts as in the conventional steam turbine construction illustrated in FIG. 1. This apparatus provides for the removal of a portion of the solid particles from the main steam flow so as to minimize damage to downstream steam path components. Generally, holes and passageways are provided in the component parts to divert a portion of the steam and hence the solid particles carried by the steam about the rotating parts. Particularly, one or more holes 60 are provided in the appendage 30 for diverting a portion of the steam flowing through the steam path through the hole 60. The hole 60 includes an inlet opening 64 upstream of the buckets 24 of the first stage and a second portion 66 on an opposite sides of a sealing device 68. A passage 70 extends through the sealing segment 68 in communication with the hole portions 64, 66, thereby constituting a through-passageway in appendage 30 for bypassing steam about the rotating parts. As illustrated, the hole portion 66 exits into a passageway 72 extending through the outer ring 40 of the second stage and on to a steam extraction passage 73.

One drawback associated with this arrangement is that the particles do not easily enter the inlet opening 64. In other words, the shape of the diaphragm surface adjacent the inlet opening does not effectively direct particles to the inlet opening. Thus, particles forced near the inlet opening by centrifugal action are often still deposited under the covers of the rotating buckets, which degrades mechanical integrity of the rotating buckets.

Further, even when particles successfully enter the inlet opening 64, they are not easily passed through the hole 60. Centrifugal action causes the particles to move radially outwardly toward the inlet opening 64; however, the hole 60 is positioned perpendicularly to the inlet opening 64 thereby requiring the particles to make a sharp turn into the hole 60. As such, passage of particles through the hole 60 is hindered by this configuration.

While many of these and other efforts to minimize or eliminate solid particle erosion have been tried in the past, solid particle erosion in steam turbines remains a continuing problem for the various parts along the steam path. Accordingly there is a need for a device to effectively minimize solid particle erosion of steam turbine components.

BRIEF SUMMARY OF THE INVENTION

In one exemplary but nonlimiting embodiment, there is provided a steam turbine comprising a first stage including a diaphragm having an inner web, an outer ring and a plurality of stator vanes therebetween; the outer ring having an axially downstream appendage overlying tips of buckets forming part of the turbine stage, the buckets having an upstream side and a downstream side, wherein steam flows through the stage in a first direction from the upstream side toward the downstream side of the buckets; and at least one slot formed in a surface of the appendage for diverting a portion of the steam in a steam flow path upstream of the buckets of the turbine stage and bypassing the buckets of said first stage.

In another exemplary but nonlimiting embodiment, there is provided a steam turbine comprising a stage including a diaphragm having an inner web, an outer ring and a plurality of stator vanes therebetween; the outer ring having an axially downstream appendage overlying tips of buckets forming part of the turbine stage, the buckets having an upstream side and a downstream side, wherein steam flows through the stage in a first direction from the upstream side toward the downstream side of the buckets; and at least one passageway formed in the appendage for diverting a portion of the steam in a steam flow path upstream of the buckets of the turbine stage and bypassing the buckets of said turbine stage, wherein the diaphragm includes a surface between the stator vanes and the buckets and adjacent the passageway, and the diaphragm surface extends at an incline with respect to the first direction of the steam flow to force particles toward the passageway.

BRIEF DESCRIPTION OF THE DRAWINGS

The accompanying drawings facilitate an understanding of the various examples of this technology. In such drawings.

DETAILED DESCRIPTION OF THE ILLUSTRATED EMBODIMENTS

Figure 4:
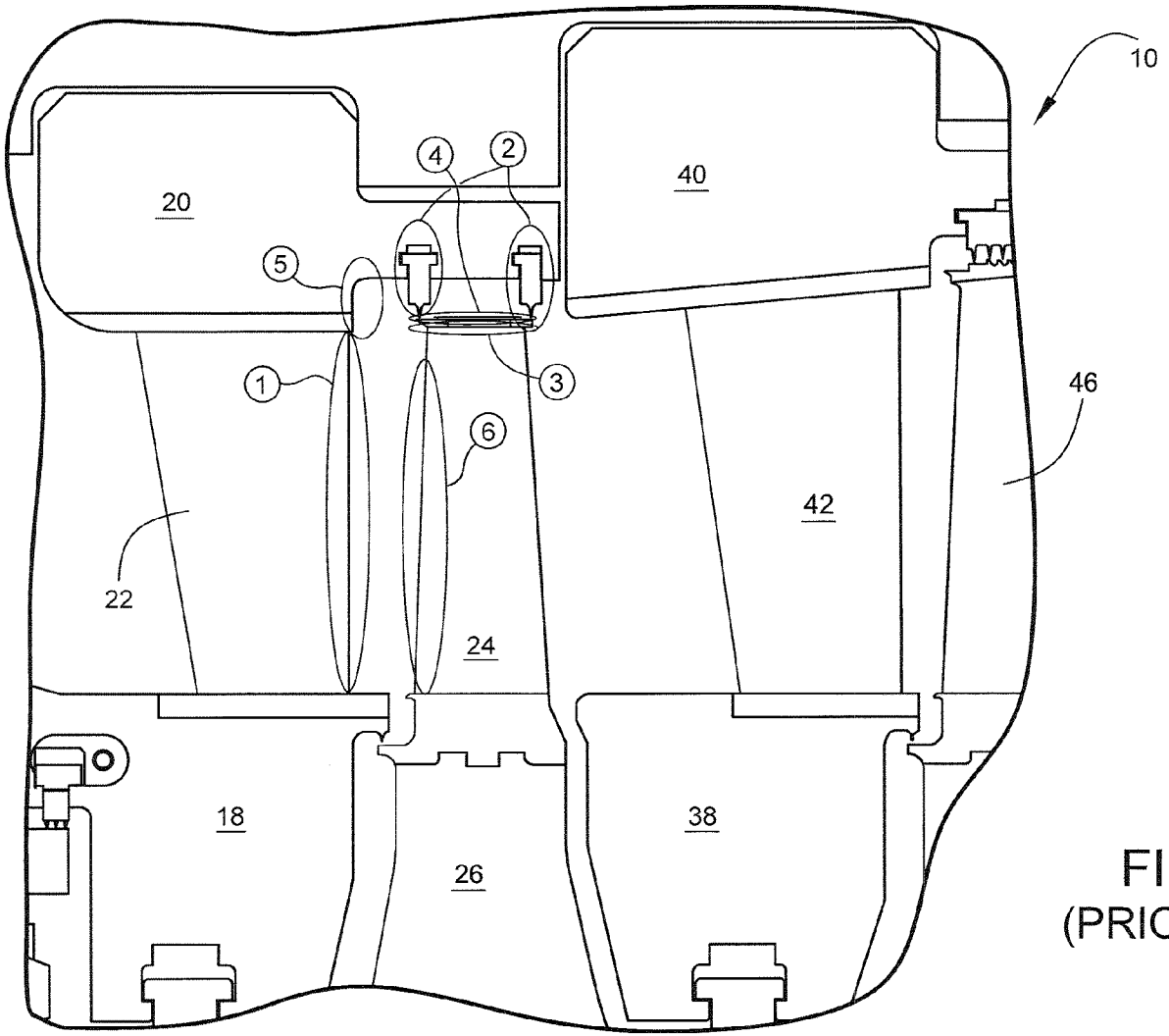
FIG. 4 (PRIOR ART)
FIG. 4 is a view similar to FIG. 1 with areas denoted by the numbered ovals indicating typical damage caused by solid particle erosion in the turbine.

Referring to FIG. 4, and as noted previously, solid particles flowing in the steam path tend to erode the various components of the turbine causing degradation in performance and efficiency. The region denoted ① in FIG. 4 constitutes the trailing edge of the partitions. Solid particle erosion in region ① can seriously affect the mechanical integrity of the stationary vanes, potentially impact the mechanical integrity of the rotating vanes due to forced response phenomena and degrade stage performance due to the increase in stationary vane area, throat shape and flow angle degradation. Region ② in FIG. 4 denotes an area of increased tip leakage of steam due to solid particle erosion to the tip sealing devices, e.g., devices 28. Region ③ in FIG. 4 denotes areas where solid particles are deposited by centrifugal action under the covers of the rotating buckets. Such deposits can degrade mechanical integrity of the rotating buckets by changing the response of the rotating structure. These deposits may also degrade performance by blockage of the rotating steam path near the tip.

Region ④ in FIG. 4 denotes solid particle erosion between the tenons and covers which can seriously affect the mechanical integrity of the covers and tenons at their connections. For example, exposure to solid particles over extended periods of time may erode the tenon, the cover, or both to the extent that their mechanical integrity is degraded, potentially leading to mechanical failure. Also, cover and tenon erosion combined with tip sealing device erosion in region ③ can decrease stage performance and efficiency due to increased tip leakage. In region ⑤ of FIG. 4, solid particle erosion causes damage to the typical outer ring cutback region which can affect the mechanical integrity of the tip sealing device retention. Solid particle erosion can also cause damage to the bucket surfaces per se, as denoted in region ⑥ in FIG. 4. Damage to the bucket surfaces can degrade stage performance due to increased surface roughness of the rotating vanes. From the foregoing, it will be appreciated that solid particle erosion may significantly damage the performance and efficiency of the variously-identified steam turbine components and seriously affect part life.

Figure 1:
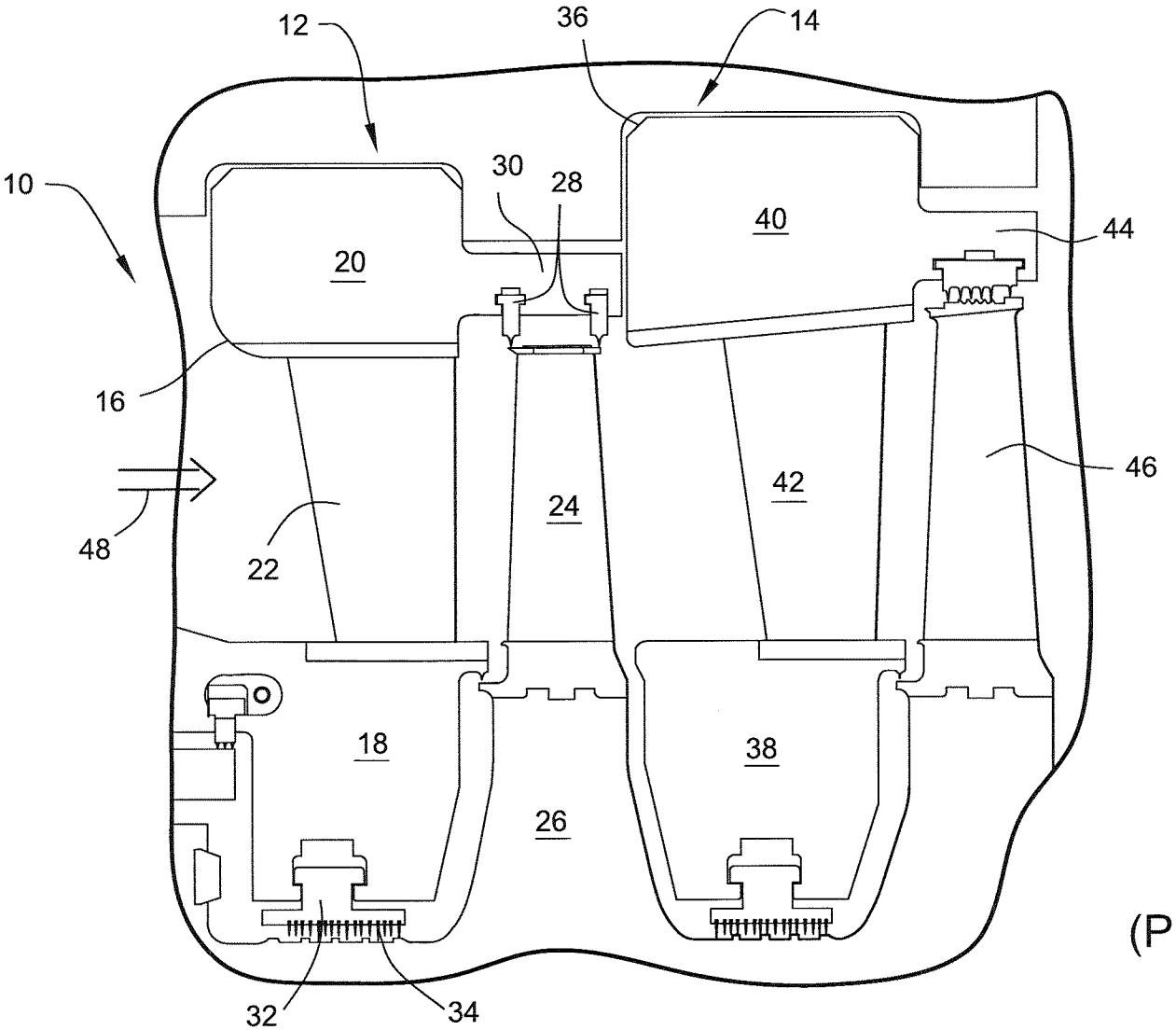
FIG. 1 (PRIOR ART)
FIG. 1 is a schematic illustration of a typical stage geometry of and function for a steam turbine.
Figure 2:
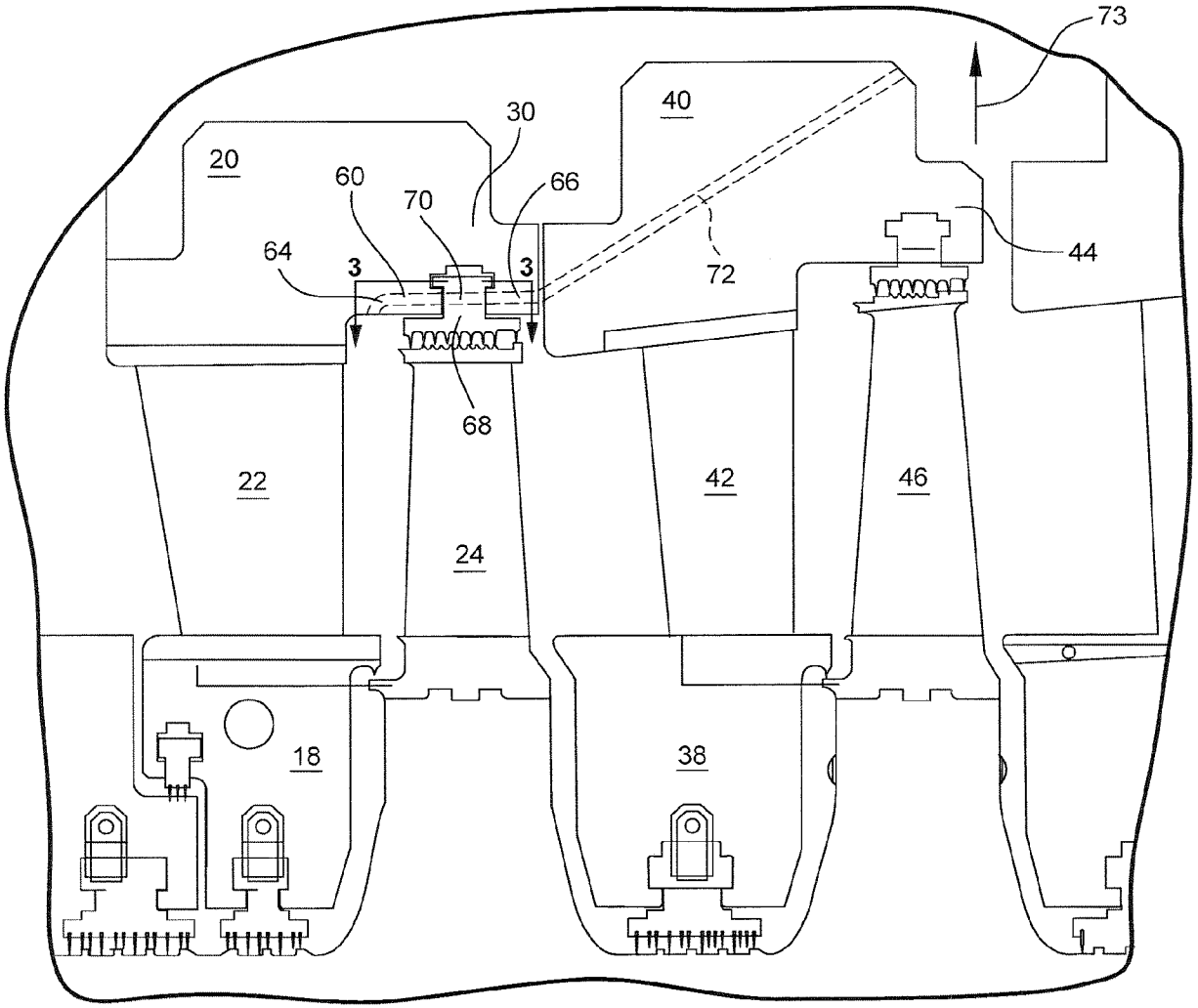
FIG. 2 (PRIOR ART)
FIG. 2 is a view similar to FIG. 1 illustrating known devices for diverting solid particles in the steam path.
Figure 3:
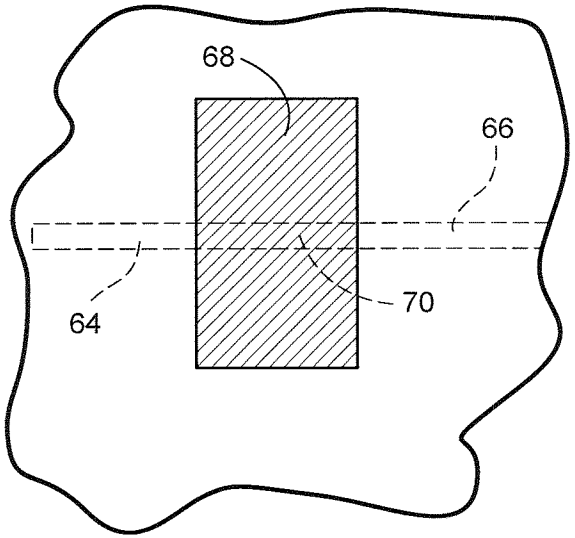
FIG. 3 (PRIOR ART)
FIG. 3 is a cross-sectional view along the line 3-3 in FIG. 2.
Figure 5:
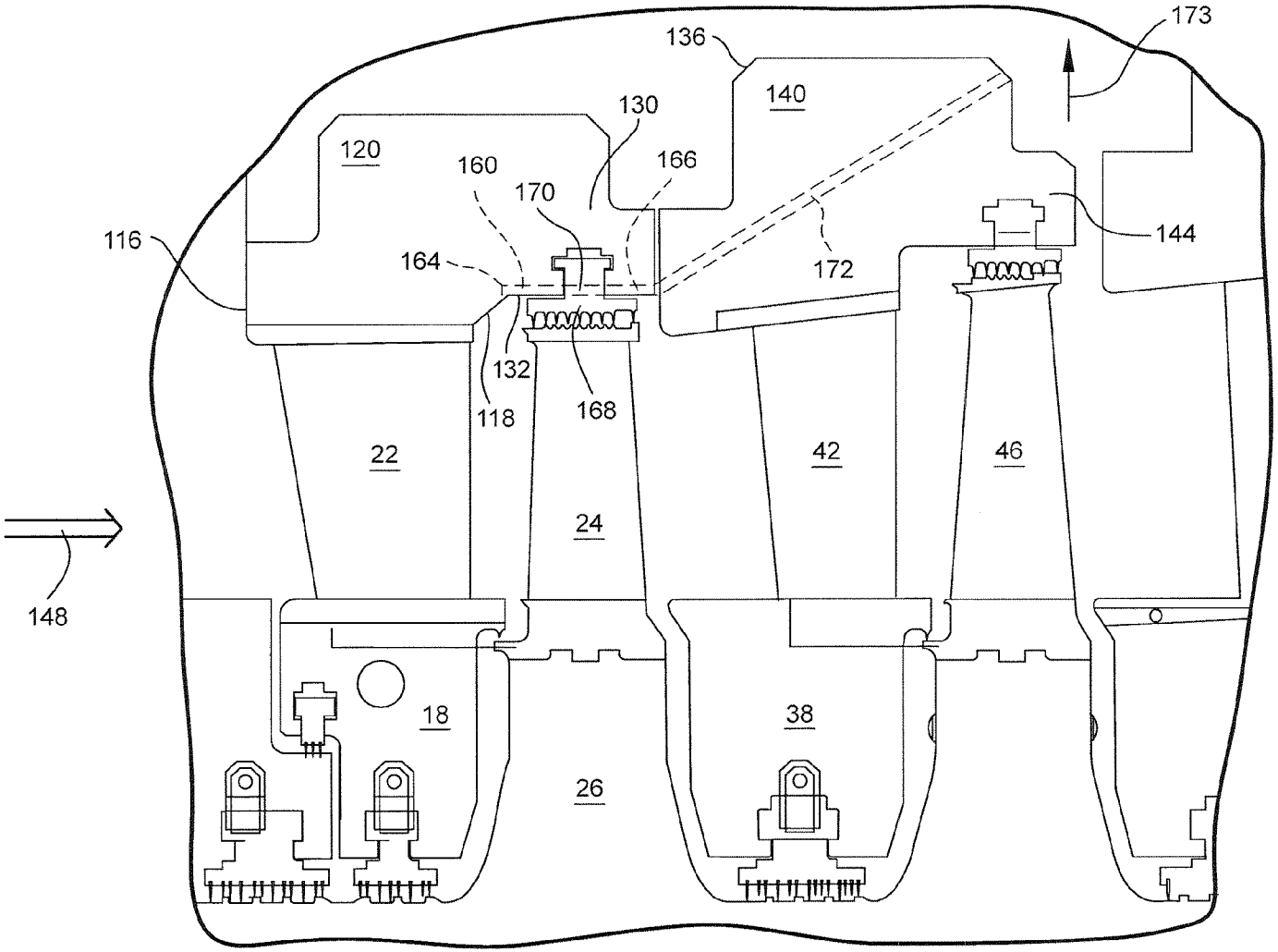
FIG. 5 is a schematic illustration of a stage geometry of a steam turbine showing devices for diverting solid particles in the steam path according to a preferred aspect of the disclosed technology.

Referring to FIG. 5, wherein like reference numerals are applied to like parts as in the conventional steam turbine construction illustrated in FIGS. 1-3, the disclosed technology provides for more effective and efficient removal of a portion of the solid particles from the main steam flow so as to minimize damage to downstream steam path components. Another function is to minimize erosion damage to the tip sealing device retention.

Figure 7:
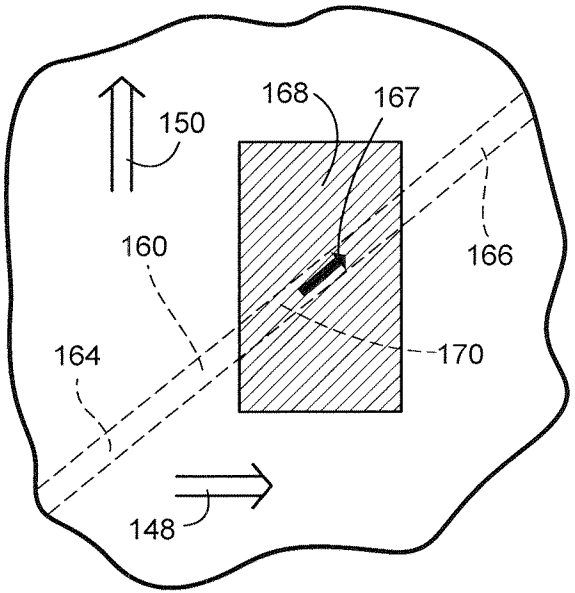
FIG. 7 is a cross-sectional view along the line 7-7 in FIG. 6.
Figure 6:
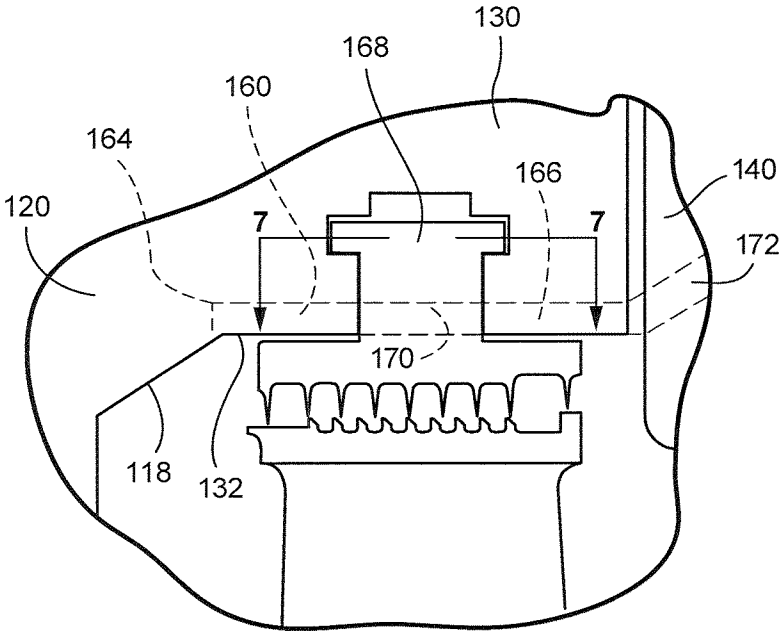
FIG. 6 is an enlarged fragmentary schematic illustration of a diaphragm appendage, e.g., a first stage diaphragm appendage and sealing device illustrating a diverted portion of the steam flow.

More particularly, and referring to FIGS. 5-7, an aspect of the disclosed technology provides one or more slots 160 in the appendage 130 for diverting a portion of the steam flowing through the steam path through the slot 160. It will be appreciated that the appendage 130 may be integral with or a separate part affixed to the ring 120. The slot 160 is formed in a lower surface 132 of the appendage 130. The slot 160 includes an opening 164 upstream of the buckets 24 of the stage, e.g., the first stage. The diaphragm 116 includes a surface 118 adjacent the slot 160. The surface 118 is slanted so as to force particles toward the slot 160. For example, the surface 118 is slanted with respect to the direction of steam flow 148. Centrifugal action will cause the particles positioned on an upstream portion of the surface 118 to travel along the surface 118 downstream to the opening 164 of the slot. Thus, the slanted surface 118 enables particles to more easily enter the opening 164.

Further, since the slot 160 is formed as an open groove in a surface of the diaphragm, particles may more easily pass along the slot as they are not required to make a sharp 90° turn into the slot 160. That is, the particles may directly enter the slot 160 which, as described below, has a directional component that extends in the direction of steam flow 148.

The slot 160 is divided into two portions 164 and 166 on opposite sides of the sealing device 168. The sealing device may comprise a spring or steam-biased sealing segment carrying labyrinth seal teeth for sealing about the tip of the rotating buckets 24. Thus, a passage 170 extends through the sealing segment 168 in communication with the slot portions 164 and 166, thereby constituting a through passageway in appendage 130 for bypassing steam about the rotating parts, i.e., the buckets 24 of the stage. As shown in FIGS. 6 and 7, the slot 160 extends in a direction 167. The direction 167 is slanted with respect to both the direction of steam flow 148 and the direction of rotation 150 of the rotor 26. Furthermore, as can be understood from FIG. 7, the direction 167 of the slot 160 has directional components that extend in both the direction of steam flow 148 and the circumferential direction of rotation of the rotor 26.

Due to rotation of the rotor 26, at least one directional component of the particles' motion before entering the slot 160 is circumferentially in the direction of rotation 150. The particles' motion also has a directional component in the direction of steam flow 148. Thus, the direction 167 of the slot 160 has directional components in the direction of rotation 150 of the rotor and the direction of steam flow 148 that are common to directional components of the particles' motion. This arrangement of the slot 160 enables the momentum of the particles before entering the opening 164 to be better utilized in helping to carry the particles through the slot 160. In essence, the change of direction required by the particles in traveling through the slot 160 is less severe as compared to the prior art device, thereby increasing the effectiveness of the device in passing particles through the slot 160.

As illustrated, the slot portion 166 exits into a passageway 172 extending through the outer ring 140 of the next, e.g., second stage. The passage 172 exits to a steam extraction passage indicated by the arrow 173 (as shown in FIG. 9) to a feed water heater or other external connection, not shown, to which the solid particles will be expelled. It will be appreciated that the FIGS. 5-9, by standard convention, are inverted such that the holes, passages and passageways are located in the bottom of the steam turbine to facilitate concentration of the solid particles and their removal and diversion from the steam path and about the rotating parts.

Figure 8:
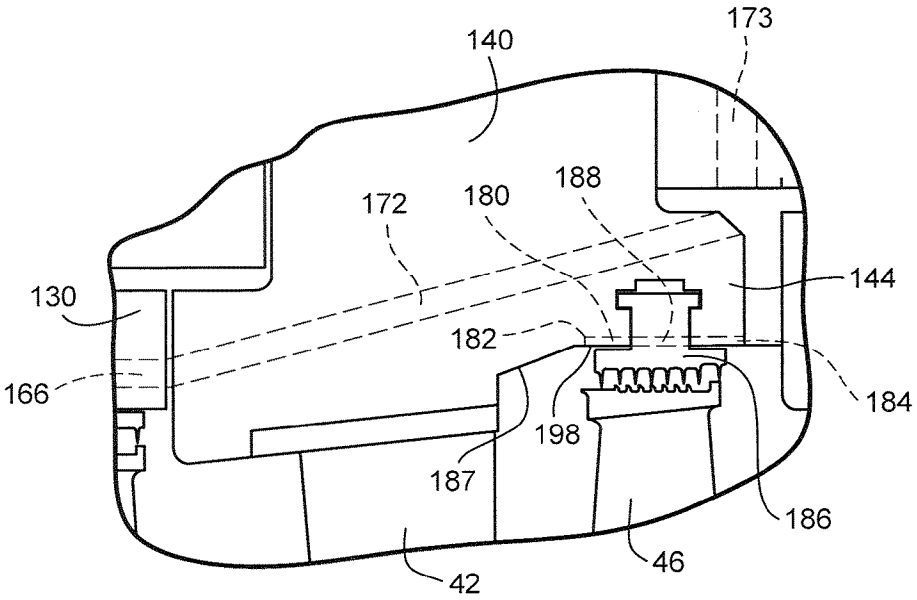
FIG. 8 is a fragmentary schematic illustration of a second stage of a steam turbine illustrating the diverted steam portions from the first and second stages.
Figure 9:
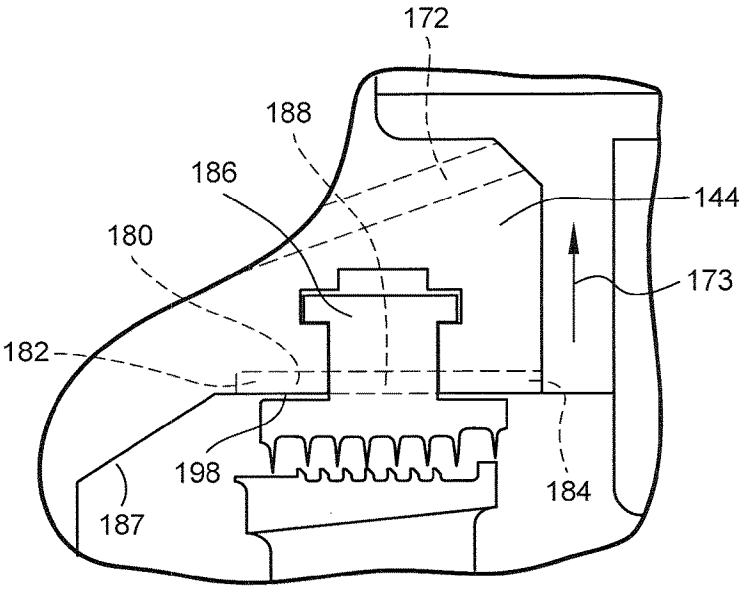
FIG. 9 is an enlarged schematic illustration of a diaphragm appendage of a second stage of the steam turbine showing the exit path of the diverted steam.

Referring to FIGS. 8 and 9, a similar arrangement for the downstream, e.g., second stage of the steam turbine is provided for diverting solid particles in the steam flow path about the rotating part of the second stage 14. Specifically, the appendage 144 of the downstream, e.g., second stage, includes a slot 180 having an opening 182 and an exit portion 184. The slot is formed in a lower surface 198 of the appendage 144. The diaphragm 136 includes a surface 187 adjacent the slot 180. The surface 187 is slanted so as to force particles toward the slot 180. Similarly, as in the first stage diversion, the sealing device 186 in the downstream stage includes a passage, i.e., a hole 188 in communication with the slot 180 whereby residual solid particle containing steam in the steam path may flow into the opening 182 through slot 180 and hole 188 for egress through exit portion 184 to the extraction passage 173 to a feed water heater or other external connection. By providing the extraction holes, passages and passageways and locating them in the bottom of the turbine, a significant portion of the solid particles in the steam path can be diverted around the rotating parts of the stages as well as certain of the stationary components, minimizing solid particle erosion of the turbine parts.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

What is claimed is:

1. A steam turbine comprising:

a first stage including a diaphragm having an inner web, an outer ring and a plurality of stator vanes therebetween;

the outer ring having an axially downstream appendage overlying tips of buckets forming part of the first stage, the buckets having an upstream side and a downstream side, wherein steam flows through the first stage in a first direction from the upstream side toward the downstream side of the buckets;

at least one slot formed in a surface of the appendage for diverting a portion of the steam in a steam flow path upstream of the buckets of the first stage and bypassing the buckets of said first stage; and a sealing device carried by the appendage at a first location fir sealing about the bucket tips, wherein the at least one slot extends along the surface of the appendage to as position downstream of the first location.

2. A turbine according to claim 1, wherein the at least one slot extends at a slant with respect to the first direction so as to extend in both a circumferential direction and an axial direction of the steam turbine.

3. A turbine according to claim 1, further comprising a passage formed through the sealing device and in communication with the slot in the appendage to bypass the diverted portion of the steam about the buckets of the first stage.

4. A steam turbine according to claim 3, wherein the sealing device lies intermediate the axial extent of the appendage, the slot in the appendage being divided into two slot portions on respective opposite sides of the passage through the sealing device.

5. A turbine according to claim 1, wherein the slot in the appendage is located adjacent a bottom of the first stage.

6. A turbine according to claim 1, further comprising a second stage downstream of the first stage and including a diaphragm having an inner web, an outer ring and a plurality of stator vanes therebetween, said second stage including a passageway through the outer ring thereof in communication with the slot through the first stage appendage to flow the diverted steam portion outside of the steam flow path bypassing the second stage.

7. A turbine according to claim 6, further comprising an extraction passage for receiving the steam diverted from the steam flow path and flowing through said second stage passageway.

8. A turbine according to claim 6, wherein the outer ring of the second stage includes an axially downstream appendage overlying tips of buckets forming part of the second stage, at least one slot formed in the second stage appendage for diverting a second portion of the steam from the steam path at a location upstream of the stator vanes and buckets of the second stage thereby bypassing the second diverted steam portion about the second stage buckets.

9. A turbine according to claim 8, further comprising a second sealing device carried by the second stage appendage and a passage formed through the second sealing device in communication with the slot in the second appendage to flow the second diverted portion of the steam to bypass the second stage buckets.

10. A turbine according, to claim 8, wherein the second diverted steam portion is extracted from the steam path at a location between the first and second stages.

11. A turbine according to claim 1, wherein the diaphragm includes a surface between the stator vanes and the buckets and adjacent the slot, and the diaphragm surface is slanted with respect to the first direction of the steam flow.

12. A steam turbine comprising:

a first stage including a diaphragm having an inner web, an outer ring and a plurality of stator vanes therebetween:

the outer ring having an axially downstream appendage overlying tips of buckets forming part of the first stage, the buckets having an upstream side and a downstream side, wherein steam flows through the first stage in a first direction from the upstream side toward the downstream side of the buckets; and at least one pathway formed in the appendage for diverting a portion of the steam in a steam flow path upstream of the buckets of the first stage and bypassing the buckets of said first stage, wherein the at least one pathway extends at a slant with respect to the first direction so as to extend in both a circumferential direction and an axial direction of the steam turbine.

13. A turbine according to claim 12, wherein the diaphragm includes a surface between the stator vanes and the buckets and adjacent the pathway, and the diaphragm surface is slanted with respect to the first direction of the steam flow to force particles toward the pathway.

14. A turbine according to claim 13, wherein the at least one pathway is at least one slot formed in a surface of the appendage.

15. A turbine according to claim 14, further comprising a sealing device carried by the appendage at a first location for sealing about the bucket tips, wherein the at least one slot extends in the surface of the appendage to a position downstream of the first location.

16. A turbine according to claim 15, further comprising a passage formed through the sealing, device and in communication with the slot in the appendage to bypass the diverted portion of the steam about the buckets of the first stage.

17. A steam turbine according to claim 16, wherein the sealing device lies intermediate the axial extent of the appendage, the slot in the appendage being, divided into two slot portions on respective opposite sides of the passage through the sealing device.

18. A turbine according to claim 12, wherein the pathway in the appendage is located adjacent a bottom of the first stage.

19. A turbine according to claim 12, further comprising a second stage downstream of the first stage and including a diaphragm having, an inner web, an outer ring and a plurality of stator vanes therebetween, said second stage including a passageway through the outer ring thereof in communication with the slot through the first stage appendage to flow the diverted steam portion outside of the steam path bypassing the second stage.

20. A turbine according, to claim 19, further comprising an extraction passage for receiving the steam diverted from the steam path and flowing through said second stage passageway.

* * * * *

UNITED STATES PATENT AND TRADEMARK OFFICE

CERTIFICATE OF CORRECTION

PATENT NO. : 9,194,259 B2
APPLICATION NO. : 13/485055
DATED : November 24, 2015
INVENTOR(S) : Mitchell It is certified that error appears in the above-identified patent and that said Letters Patent is hereby corrected as shown below:

In the Claims:

In Claim 1 at column 5, line 60, change “fir sealing” to --for sealing--.

In Claim 1 at column 5, line 62, change “to as position downstream” to --to a position downstream--.

In Claim 10 at column 6, line 39, change “according, to” to --according to--.

In Claim 12 at column 6, line 48, change “therebetween:” to --therebetween;--.

In Claim 16 at column 7, line 10, change “sealing, device” to --sealing device--.

In Claim 17 at column 7, line 15, change “being, divided” to --being divided--.

In Claim 19 at column 7, line 22, change “having, an inner web” to --having an inner web--.

In Claim 20 at column 7, line 28, change “according, to” to --according to--.

Signed and Sealed this
First Day of March, 2016

Michelle K. Lee

Michelle K. Lee
*Director of the United States Patent and Trademark Office*